United States Patent [19]

Linder

[11] 4,113,218

[45] Sep. 12, 1978

[54] ADJUSTABLE FRAME ASSEMBLY FOR SUPPORTING A SURGICAL TRAY

[76] Inventor: Gerald S. Linder, 16693 Charmel La., Pacific Palisades, Calif. 90272

[21] Appl. No.: 722,798

[22] Filed: Sep. 13, 1976

[51] Int. Cl.[2] ..... A61G 13/00

[52] U.S. Cl. ..... 248/291; 248/124; 248/133; 211/86; 5/317 R

[58] Field of Search ..... 248/291, 284, 298, 133, 248/139, 122, 124; 211/88, 126, 133, 86; 32/22; 21/83; 5/332, 317 R, 92; 297/194, 148–155

[56] References Cited

U.S. PATENT DOCUMENTS

| | | | |
|---|---|---|---|
| 952,671 | 3/1910 | Hencke | 297/149 |
| 1,072,248 | 9/1913 | McNaughton | 211/86 X |
| 1,903,314 | 4/1933 | Ornberg | 248/284 X |
| 2,448,734 | 9/1948 | Phillips | 5/317 R X |
| 2,628,803 | 2/1953 | Krewson | 248/124 |
| 2,678,792 | 5/1954 | Gallion et al. | 211/86 X |
| 2,719,691 | 10/1955 | Vance | 248/298 X |
| 3,362,673 | 1/1968 | Patch | 248/133 X |
| 3,774,325 | 11/1973 | Johnson et al. | 248/122 X |
| 3,794,280 | 2/1974 | Atkin | 248/291 X |
| 3,859,993 | 1/1975 | Bitner | 211/88 X |

FOREIGN PATENT DOCUMENTS

| | | | |
|---|---|---|---|
| 712,506 | 10/1931 | France | 248/291 |

*Primary Examiner*—Ramon S. Britts
*Attorney, Agent, or Firm*—B. F. Spencer

[57] ABSTRACT

An adjustable frame assembly for attachment to the sides of a hospital operating table is disclosed for supporting a removable surgical tray above the operating table and over the patient in a variety of positions for the convenience of personnel. The frame assembly consists of two upright supporting columns, one attached to each side of the operating table at an appropriate position. A horizontal bar is mounted between the upper ends of the upright supporting columns and extends across the operating table from one side to the other. A rectangular open frame member is supported by mechanical linkages to a pair of vertically-extending posts adjustably mounted, respectively, upon two slidable blocks carried by the horizontal bar. A removable surgical tray may be placed upon the open rectangular frame and clamped into position. The position of the surgical tray may be raised and lowered over the patient, may be moved about in a plane, or may be tilted or inclined as necessitated by the nature of the operation to increase the convenience, efficiency, and speed in the use of the surgical instruments placed upon the tray. The adjustable frame assembly with the surgical tray in place may serve also as a stable support for a sterile screen.

18 Claims, 3 Drawing Figures

FIG. 1
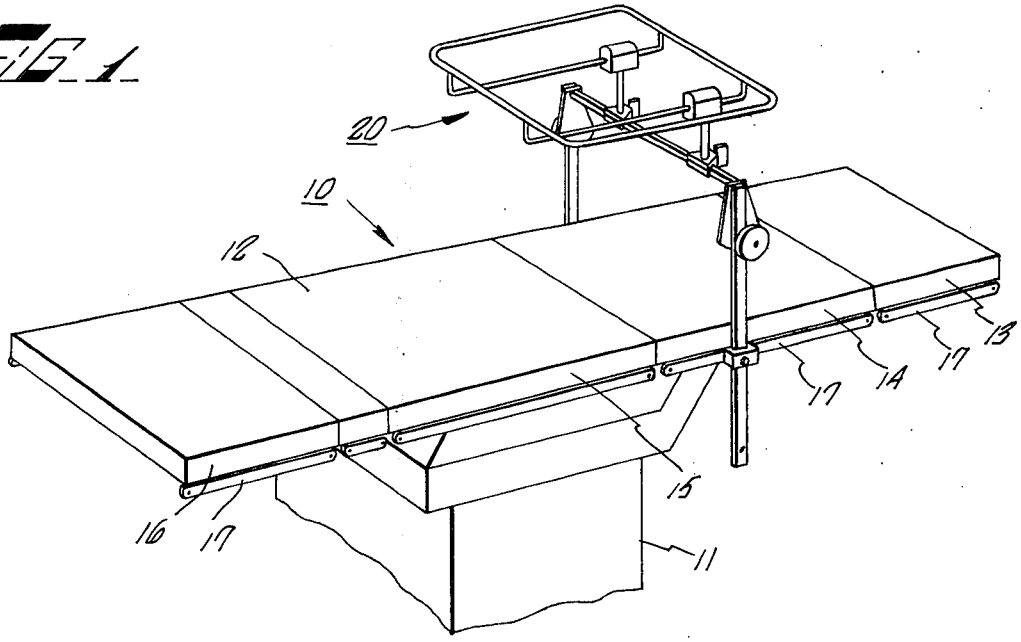
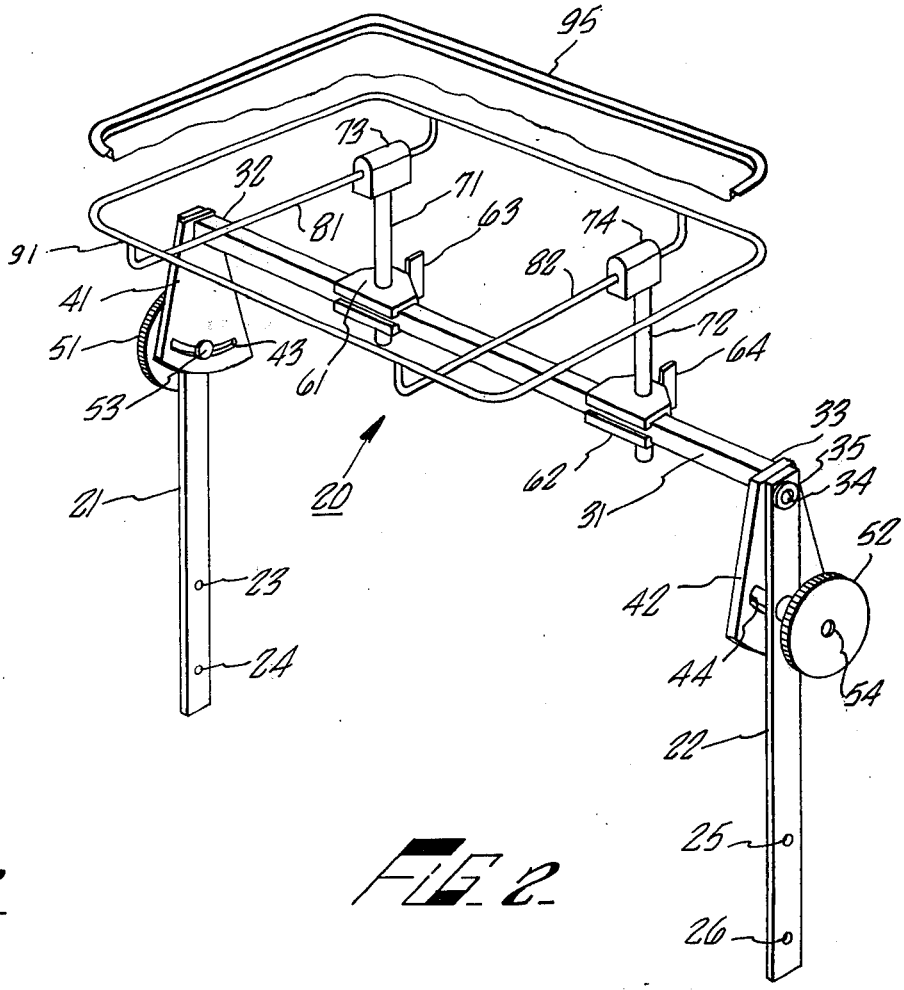
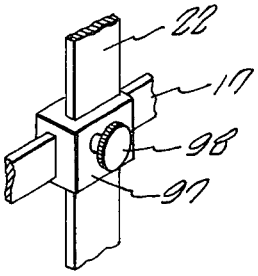
FIG. 3
FIG. 2

ADJUSTABLE FRAME ASSEMBLY FOR SUPPORTING A SURGICAL TRAY

BACKGROUND OF THE INVENTION

The conventional operating table in use in hospital operating rooms consists of a base mounted upon adjustable casters, a central elevating column extending upward from the base, and a table top composed of several sections each of which may be independently adjusted with respect to the other. The operating table may be rolled into a desired position and the casters released, allowing the base to rest firmly upon floor jacks.

The operating table is provided with controls for selecting a variety of operating positions. To accommodate these various positions, the table top generally comprises a head rest, back section, seat section and leg section. The table top may be articulated by these controls to provide such operating positions as Trendelenburg, lateral tilt, reflex-abdominal, kidney, gall bladder, chair, lithotomy and proctology, to mention a few.

A number of accessories are used in conjunction with the standard operating table depending, in part, upon the nature of the operation. These may include an arm rest, leg holder, a foot extension, and an anesthesia screen support, for example. In addition, a movable floor stand for supporting a surgical tray is generally placed in position next to the operating table for holding the instruments needed for the operation. This floor stand consists of a single vertical column mounted upon a forked base member and supporting a cantilevered frame for holding the surgical tray. The frame supporting the tray may be raised or lowered relative to the floor of the operating room by means of a hand crank.

When positioned adjacent the operating table, the conventional floor stand presents a number of serious problems. For certain operations, such as open heart, kidney and gall bladder for example, the presence of the floor stand crowds the surgeon and obstructs his freedom of movement. In certain instances, it may become necessary to move the floor stand, causing a shift in the location of the surgical tray with its instruments. In other cases, the location of the floor stand obstructs the view of the site of the operation to the assisting personnel. In cases requiring an unrestricted view of the site of the operation by the surgical team, the floor stand with its tray of instruments may be positioned beyond the reach of the surgeon, thereby requiring the instruments to be handled by a nurse.

Other problems are presented by the presence of the floor stand when it becomes necessary to raise or lower the operating table during the operation, which may require the simultaneous raising or lowering of the surgical tray with its instruments by assisting personnel. Additional problems arise when movement of operating room personnel may inadvertently cause an undesired movement of the floor stand with its tray of instruments, should personnel step upon or accidently kick the forked base member or lean against the stand during an operation.

The present invention overcomes the above serious problems by the complete elimination of the need for the floor stand, thereby resulting in an appreciable increase in working space surrounding the site of the operation while placing the surgical tray in a more suitable location within easy reach of the operating surgeon.

Accordingly, a principal object of the invention is the placement of a surgical tray, with its surgical instruments, in a position providing a minimum of obstruction to the operating surgeon.

Another object is to provide a universally adjustable frame assembly that may be conveniently and rigidly attached to an operating table for supporting a surgical tray in a position that the operating surgeon finds most efficient.

Another important object is to provide a frame assembly attached to an operating table for supporting both surgical tray and sterile screen in a relatively fixed position to the operating table as the operating table is raised, lowered, tilted or inclined.

A further object is to provide an adjustable frame assembly for supporting a surgical tray above the patient in a variety of locations as may be most suitable for the type of operation to be performed.

An additional object is to provide an adjustable open frame assembly for supporting a removable surgical tray which will result in a minimum of interference with, or obstruction to, the assisting personnel.

BRIEF DESCRIPTION OF THE DRAWINGS

FIG. 1 is a view of a conventional hospital operating table with the adjustable frame assembly of the present invention installed.

FIG. 2 is an enlarged perspective view of the adjustable frame assembly of the invention adapted to receive a surgical tray.

FIG. 3 illustrates the manner in which the upright supporting columns of the frame assembly of the invention are attached to the side rails of the operating table.

DESCRIPTION OF THE INVENTION

Referring to FIG. 1, a conventional hospital operating table 10 is illustrated having a central elevating column 11 supporting a padded table top 12 consisting of a number of adjustable sections. The head rest 13 appears at the right hand end of table top 12, followed by a back or chest section 14, a seat section 15, and a foot section 16. Standard side rails 17 are attached to each individual section along each side of the table 10 for use with accessories.

The adjustable sections 13–16 may be positioned into a number of basic operating positions by conventional controls (not shown) located beneath the operating table immediately below head section 13. These controls are usually located at the end of a movable control arm for the convenience of hospital personnel. The anesthetist, stationed at the head position of the table, may, during the course of an operation, readjust the positions of the various sections as may be required by the operating surgeon.

The height of a conventional operating table may be raised or lowered with respect to the floor of the operating room over a range of approximately eighteen inches; may be laterally tilted by as much as plus or minus 20°; inclined or Trendelenburg by as much as plus or minus 30°; and flexed into a number of basic operating positions such as gall bladder, lithotomy, neurosurgery, proctology and kidney articulations.

The adjustable frame assembly 20 of the present invention for supporting the surgical tray is shown attached to side rails 17 at the back or chest section 14 of the operating table and will be described in detail below.

Referring to FIG. 2, the adjustable frame assembly 20 includes first and second upright supporting columns 21, 22 of rectangular cross-section. The lower ends of each of these supporting columns are provided with pairs of holes 23, 24 and 25, 26 for securing the supporting columns to the side rails 17 of operating table 10, as shown in detail in FIG. 3. These holes enable the frame assembly to be mounted at one of two different appropriate heights above the table top 12. The upper end of each supporting column 21, 22 is provided with a round hole for receiving the ends of horizontal bar 31.

Horizontal bar 31 of square cross-section over most of its length extends from one side to the other side of the conventional operating table. Each of the ends 32, 33 of the bar is machined to be cylindrical in shape in order to rotatably fit within the rounded holes at the upper ends of the first and second supporting columns 21, 22, respectively. The center of each end 32, 33 is tapped for receiving a machine screw 34 with washer 35, as shown at the upper end of column 22, for rotatably securing bar 31 between the upper ends of the two upright supporting columns.

Bar 31 is provided with limited angular rotation about its longitudinal axis with respect to the supporting columns by first and second arm members 41, 42 which extend perpendicular to the longitudinal axis of the bar and parallel, respectively, with support columns 21, 22. The upper ends of arm members 41, 42 are provided with a square aperture to fit over square bar 31. The lower ends of the arm members are provided with arcurate slots 43, 44, respectively, for determining the extent of angular rotation of bar 31.

First and second knurled locking knobs 51, 52 are supported by columns 21, 22, respectively, opposite the arcurate slots 43, 44. Threaded bolts 53, 54 extend through the arcurate slots 43, 44, respectively, and through apertures in the supporting columns into the threaded bores of knobs 51, 52. The amount of angular rotation of bar 31 about its longitudinal axis is determined by the length of the arcurate slots 43, 44 and may extend over a range of plus or minus thirty degrees, for example.

First and second blocks 61, 62 with square apertures are slidably mounted upon horizontal bar 31. Each block is provided with a cylindrical hole extending entirely through the block and perpendicular to the longitudinal axis of bar 31. The position of each cylindrical hole is located such that an opening exists within each block between the inner surface of the cylindrical hole adjacent the horizontal bar 31 and the square aperture through the block. Opposite each of these openings and threadably mounted into each block are first and second locking wing bolts 63, 64.

A removable open frame unit consisting of first and second vertically-extending posts 71, 72; first and second U-shaped connecting members 81, 82; and a rectangular frame 91 is supported by the slidable blocks 61, 62 and forms part of the frame assembly of the invention. The vertically-extending posts 71, 72 are cylindrical in shape and are slidably mounted, respectively, in the cylindrical holes of blocks 61, 62. The posts are locked in position by rotatably advancing the locking wing bolts 63, 64 which presses posts 71, 72 firmly against the surface of horizontal bar 31 through the openings within each of the blocks described above. This locking procedure not only locks the position of the vertically-extending posts 71, 72 with respect to their corresponding blocks 61, 62 but also locks the position of blocks 61, 62 with respect to horizontal bar 31.

The upper ends 73, 74 of vertically-extending posts 71, 72 are provided with a cylindrical aperture or bushing extending perpendicular to the axes of the posts for journally supporting the straight, central portion of members 81, 82. The straight, central portion of members 81, 82 are longitudinally slidable through and angularly positionable within their journal supports, respectively. The vertically-extending ends of U-shaped members 81, 82 are securely attached to the lower surface of rectangular frame 91, as shown.

The rectangular frame 91 is provided with rounded corners and is adapted for receiving a standard surgical tray 95. The open frame unit consisting of rectangular frame 91 and its connecting members 81, 82 and vertically-extending posts 71, 72 may be removed from supporting blocks 61, 62 and replaced with either larger or smaller size units to accommodate the different sizes of standard surgical trays, as may be required by the nature of the operation.

FIG. 3 illustrates the manner in which vertical column 22 is attached to side rail 17 of the operating table 10. A square block 97 is provided with a horizontally-extending rectangular aperture or slot for sliding over the ends of the side rail 17 to the position at which the adjustable frame assembly 20 is to be located. The upright supporting column 22 is then inserted into a vertically-extending rectangular aperture or slot within square block 97, as shown, until one of the holes 25 or 26 at the lower end of column 22 is aligned with the center of the block. A threaded thumb screw 98 is then inserted into block 97 passing through one of the holes 25 or 26 and tightened against side rail 17.

The location and position of the adjustable frame assembly 20 over the operating table is determined primarily by the nature of the operation to be performed. For eye, hip, or plastic surgery, the frame assembly is generally located over the chest or back section 14, as illustrated in FIG. 1. For leg or knee surgery, the frame assembly is located over seat section 15, while for abdominal surgery, the frame assembly may be located over foot section 16. For kidney heart, back, or chest operations, the assembly is located over head section 13.

The position and level of the surgical tray over the operating table is readily adjusted by knurled locking knobs 51, 52; by wing bolts 63, 64, and by sliding the U-shaped supporting members 81, 82 through their journal supports. For example, in Trendelenburg, reverse Trendelenburg, or in flex, the operating table, or certain of its sections, is inclined. To maintain the surgical tray level, it is necessary to adjust the angular position of horizontal bar 31 about its longitudinal axis. This is accomplished by loosening knurled knobs 51, 52 and adjusting the angular position of arm members 41, 42 relative to supporting columns 21, 22.

For operations requiring the table to be laterally tilted, adjustment of the height of one or both vertically-extending posts 71, 72 is necessary to maintain the tray level. This is achieved by loosening one or both of the wing bolts 63, 64. If desired, the tray may be positioned closer to one side of the operating table than the other by laterally sliding the open frame unit with both blocks 61, 62 along horizontal bar 31.

The surgical tray may be moved about in a flat plane, if desired, by sliding rectangular frame 91 with its supporting members 81, 82 through their journal supports in the upper ends 73, 74, respectively, of posts 71, 72.

It also is possible to rotate the surgical tray through a limited angle about a vertical axis by slightly rotating one or both of the vertically-extending posts 71, 72 while sliding supporting members 81 or 82 through their journal supports. This procedure places the surgical tray at an angle relative to the side of the operating table for the convenience of the surgeon.

An important feature of the invention is the use of the adjustable frame assembly with surgical tray in place as a support for a sterile screen, thereby shielding the sterile site of the operation from the station of the anesthesiologist. Since the adjustments for the positioning of the frame assembly are located below the sterile screen and within easy reach of the anesthesiologist, or assisting personnel, the readjustment of the position of the surgical tray with its instruments in place may be readily accomplished even during the performance of the operation, when necessary. This feature provides maximum convenience and efficiency to the operating surgeon without danger of compromising the sterile field.

The operating table may be raised or lowered when desired without the necessity of adjusting the location or position of the adjustable frame assembly and without disturbing the placement and support of the sterile screen. The surgical tray may be readily removed from the frame assembly during an operation, if necessary, without disturbing the position and adjustments to the assembly.

The adjustability of the frame assembly provides a wide variety of important uses for the invention. If desired, the frame assembly may be mounted on one side only of the operating table by suitable modification of upright supporting columns 21, 22 or by providing a suitable adapter fixture for securing the supporting columns to side rails 17. With this installation the functions of knurled knobs 51, 52 and wing bolts 63, 64 would be reversed.

Since many changes could be made in the above construction and many different embodiments of this invention could be made without departing from the scope thereof, it is intended that all matter in the above description or shown in the accompanying drawing shall be interpreted as illustrative and not in a limiting sense.

What is claimed is:

1. An adjustable frame assembly adapted for attachment to an operating table for receiving and supporting a surgical tray above the operating table, comprising in combination:

(a) first and second upright supporting columns, each having an upper and a lower end, the lower end of each of said first and second supporting columns being adapted for secure attachment to the operating table;

(b) a horizontally-extending bar mounted between the upper ends of said first and second supporting columns for limited angular rotation about the longitudinal axis of said bar with respect to said supporting columns;

(c) at least one locking means intercoupled between one end of said horizontally-extending bar and one of said first or second supporting columns for locking the angular position of said horizontally-extending bar with respect to said one supporting column;

(d) first and second blocks spaced apart and mounted upon said horizontally-extending bar intermediate the ends of said bar;

(e) first and second vertically-extending posts supported, respectively, by said first and second blocks, said first and second posts extending substantially perpendicular to the longitudinal axis of said horizontal bar;

(f) a substantially rectangular open frame member adapted for receiving and supporting a surgical tray; and (g) first and second connecting members supported, respectively, by the upper ends of said first and second vertically-extending posts, said first and second connecting members having vertically-extending ends attached to said rectangular open frame member.

2. The adjustable frame assembly as defined by claim 1 further comprising another locking means intercoupled between the other end of said horizontally-extending bar and the other of said first or second supporting columns for locking the angular position of said horizontally-extending bar with respect to said other supporting column.

3. The adjustable frame assembly as defined by claim 1 wherein said first and second blocks are slidably mounted upon said horizontally-extending bar, and means associated with at least one of said first or second blocks for locking the position of said one block relative to said horizontally-extending bar.

4. The adjustable frame assembly as defined by claim 1 wherein said horizontally-extending bar has a substantially rectangular cross section.

5. The adjustable frame assembly as defined by claim 1 wherein at least one of said first or second vertically-extending posts is slidably mounted within its corresponding block for adjusting the vertical extent to which said one post projects above said corresponding block, and means associated with said corresponding block for locking the position of said one vertically-extending post to said corresponding block.

6. The adjustable frame assembly as defined by claim 1 wherein each of said first and second vertically-extending posts is slidably mounted, respectively, within said first and second blocks for adjusting the vertical extent to which said posts project above their corresponding blocks, and means associated with each of said first and second blocks for locking the position of said first and second vertically-extending posts, respectively, with respect to said first and second blocks.

7. The adjustable frame assembly as defined by claim 6 wherein said means associated with each of said first and second blocks for locking the position of said first and second vertically-extending posts, respectively, with respect to said first and second blocks further locks the position of each of said first and second blocks, respectively, with respect to said horizontally-extending bar.

8. The adjustable frame assembly as defined by claim 1 wherein said substantially rectangular frame member is provided with rounded corners.

9. The adjustable frame assembly as defined by claim 1 wherein the central portion of each of said first and second connecting members is journally supported within the upper ends, respectively, of said first and second vertically-extending posts, said first and second connecting members being angularly positionable within their journal support.

10. The adjustable frame assembly as defined by claim 9 wherein the central portion of each of said first and second connecting members is longitudinally slidable through its journal support.

11. An adjustable frame assembly adapted for attachment to the sides of a hospital operating table, said frame assembly being positionable above the operating table for receiving and supporting a removable surgical tray, comprising in combination:

(a) first and second upright supporting columns each having an upper and lower end, the lower ends of each of said first and second columns being adapted for secure attachment, respectively, to each side of the operating table;

(b) a horizontal bar located above and extending across the operating table, said horizontal bar being pivotally mounted between the upper ends of said first and second upright supporting columns for limited angular rotation about the axis of said bar with respect to said columns;

(c) at least one arm member having a first end attached to one end of said horizontal bar, said arm member extending perpendicular to the axis of said bar and parallel with one of said first or second upright supporting columns;

(d) locking means intercoupled between the other end of said arm member and said one upright supporting column for locking the angular position of said horizontal bar with respect to said one upright supporting column;

(e) first and second blocks spaced apart and slidably mounted upon said horizontal bar;

(f) first and second vertically-extending posts mounted, respectively, within said first and second slidable blocks, said first and second posts extending perpendicularly to the axis of said horizontal bar, at least one of said first or second posts being slidably mounted within its corresponding slidable block;

(g) a substantially rectangular frame member having rounded corners and adapted for receiving and supporting a standard surgical tray; and (h) first and second connecting members supported respectively by the upper ends of said first and second vertically-extending posts, said first and second connecting members having vertically-extending ends attached to the lower surface of said substantially rectangular frame.

12. An adjustable frame assembly adapted for attachment to the sides of a hospital operating table for receiving and supporting a surgical tray above the operating table, comprising in combination:

(a) first and second upright supporting columns each having an upper and a lower end, the lower ends of each of said first and second supporting columns being adapted for secure attachment, respectively, to each side of the operating table;

(b) a horizontally-extending bar located above and extending from one side to the other side of the operating table, said horizontal-extending bar being mounted between the upper ends of said first and second supporting columns;

(c) first and second blocks spaced apart and slidably mounted upon said horizontally-extending bar intermediate the ends of said bar;

(d) means associated with at least one of said first or second blocks for locking the position of said one block relative to said horizontal-extending bar;

(e) first and second vertically-extending posts supported, respectively, by said first and second blocks, said first and second posts extending substantially perpendicular to the longitudinal axis of said horizontal bar, at least one of said first or second vertically-extending posts being slidably mounted within its corresponding block for adjusting the vertical extent to which said one post extends above said corresponding block;

(f) means associated with said corresponding block for locking the position of said one vertically-extending post to said corresponding block;

(g) a substantially rectangular open frame member adapted for receiving and supporting a standard surgical tray; and (h) first and second connecting members supported, respectively, by the upper ends of said first and second vertically-extending posts, said first and second connecting members having vertically-extending ends attached to said rectangular open frame member.

13. The adjustable frame assembly as defined by claim 12 wherein the central portion of said first and second connecting members is journally supported within the upper ends, respectively, of said first and second vertically-extending posts, said first and second connecting members being angularly positionable within and slidable through their corresponding journal supports.

14. The adjustable frame assembly as defined by claim 12 wherein said means associated with said corresponding block for locking the position of said one vertically-extending post to said corresponding block includes a screw threadably mounted within said corresponding block for holding said one vertically-extending post into physical engagement with said horizontal bar upon rotational advancement of said screw.

15. The adjustable frame assembly as defined by claim 14 wherein said means associated with at least one of said first or second blocks for locking the position of said one block relative to said horizontal bar includes said screw threadably mounted within said corresponding block for holding said one vertically-extending post into physical engagement with said horizontal bar upon rotational advancement of said screw.

16. A removable open frame unit adapted for use with and forming a part of an adjustable frame assembly for receiving and supporting a surgical tray, comprising in combination:

(a) a substantially rectangular frame member adapted for receiving a surgical tray;

(b) first and second vertically-extending posts adapted for attachment to said adjustableframe assembly; and (c) first and second U-shaped connecting members attached to and adjustably supported, respectively, by the upper ends of said first and second vertically-extending posts, each of said first and second U-shaped connecting members having a vertically-extending portion at each end thereof with said ends being respectively of opposed frame elements attached to the lower surface of said substantially rectangular frame.

17. The removable open frame unit as defined by claim 16 wherein the central portion of said first and second U-shaped connecting members is journally supported within the upper ends, respectively, of said first and second vertically-extending posts, said first and second U-shaped connecting members being angularly positionable within and slidable through their corresponding journal supports.

18. An adjustable frame assembly adapted for attachment to the side of an operating table for receiving and supporting a removable surgical tray, comprising in combination:

(a) at least one upright supporting column having an upper and a lower end, the lower end of said one supporting column being adapted for secure attachment to one side of the operating table;

(b) a horizontally-extending bar having one end mounted to the upper end of said upright supporting column, said horizontally-extending bar being adapted for positioning above and extending over the operating table;

(c) first and second blocks spaced apart and slidably mounted upon said horizontally-extending bar intermediate the ends of said bar, said first and second blocks being provided with means for preventing their angular rotation about the longitudinal axis of said horizontally-extending bar as they are slidably positioned intermediate the ends of said bar;

(d) means associated with at least one of said first or second blocks for locking the position of said one block relative to said horizontally-extending bar;

(e) first and second vertically-extending posts supported, respectively, by said first and second blocks, said first and second posts extending substantially perpendicular to the longitudinal axis of said horizontal bar, at least one of said first or second vertically-extending posts being slidably mounted within its corresponding block for adjusting the vertical extent to which said one post extends above said corresponding block;

(f) means associated with said corresponding block for locking the position of said one vertically-extending post to said corresponding block;

(g) a substantially rectangular open frame member adapted for receiving and supporting a standard surgical tray; and (h) first and second connecting members supported respectively by the upper ends of said first and second vertically-extending posts, said first and second connecting members having vertically-extending ends attached to the lower surface of said substantially rectangular frame.

* * * * *